United States Patent [19]

Standing

[11] 4,407,485

[45] Oct. 4, 1983

[54] ELECTRIC FENCE STANDARD

[75] Inventor: Colin A. Standing, Cambridge, New Zealand

[73] Assignee: Gallagher Electronics Limited, Hamilton, New Zealand

[21] Appl. No.: 333,987

[22] Filed: Dec. 23, 1981

[30] Foreign Application Priority Data

Dec. 23, 1980 [NZ] New Zealand ..... 195922

[51] Int. Cl.[3] ..... A01K 3/00; H05C 1/00

[52] U.S. Cl. ..... 256/10

[58] Field of Search ..... 256/10; 174/163 F, 161 F, 174/158 F

[56] References Cited

U.S. PATENT DOCUMENTS 4,061,312 12/1977 Walchuk ..... 256/10

4,078,771 3/1978 Diggs ..... 256/10

FOREIGN PATENT DOCUMENTS 163589 6/1955 Australia ..... 256/10

1164740 3/1964 Fed. Rep. of Germany ..... 256/10

*Primary Examiner*—Wayne L. Shedd

*Attorney, Agent, or Firm*—Abelman, Frayne & Rezac

[57] ABSTRACT

This invention relates to wheel-like electric fence standards where an electrified fence wire passes through an insulated hub member from which radiates a number of legs to form a wheel-like configuration and is characterized in that a contactor within the hub automatically connects and disconnects successively the legs from the fence wire to prevent the legs in contact with the ground from short-circuiting the fence.

7 Claims, 3 Drawing Figures

ELECTRIC FENCE STANDARD

This invention relates to wheel-like electric fence standards.

In such electric fence standards an electrified fence wire passes through an insulated hub member from which radiates a number legs to form a wheel-like configuration. The fence standards are provided with lateral support by stabiliser tubes or arms extending in an axial direction from the hub. To discourage animals grazing within a fenced area from interfering with the standards it is desirable that the spokes of the standards be live and to avoid shor-circuiting of the electric fence it is necessary to insulate the standard from the ground surface below.

It is an object of the present invention to provide an electric fence standard wherein only the legs or a leg not in contact with the ground surface below are/is electrified.

Further objects and advantages of the present invention will become apparent from the ensuing description.

SUMMARY OF INVENTION

According to a first aspect of the present invention there is provided an electric fence standard for supporting a fence wire above a ground surface such that the standard is rotatable about the wire to permit translation of the wire, the electric fence standard comprising, an insulated hub through which the wire passes, a plurality of electrically conductive legs extending radially outwardly from the hub, and a contactor mounted by the hub which is adapted to make contact with all legs of the fence standard except those in contact with the ground surface at a given time.

According to yet a further aspect of the present invention there is provided an electric fence standard as aforesaid wherein the contactor is an electrically conductive disc.

BRIEF DESCRIPTION OF THE DRAWINGS

Aspects of the present invention will now be described by way of example with reference to the accompanying drawings in which.

DESCRIPTION OF THE INVENTION

Figure 1:
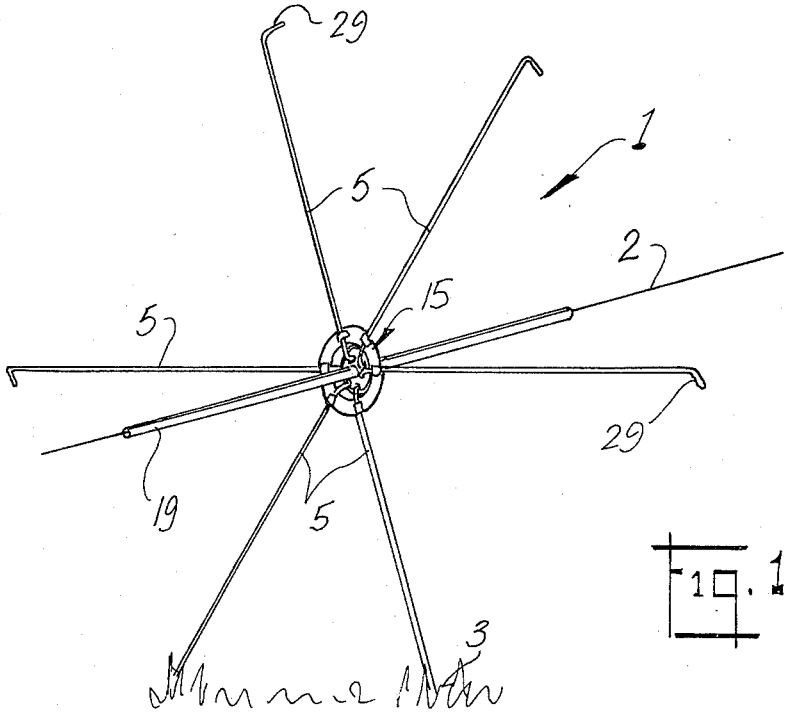
FIG. 1 is a diagrammatic perspective view of an electric fence wire and standard in accordance with the present invention.

With reference firstly to the drawings an electric fence standard generally indicated by arrow 1, and in accordance with the present invention, is arranged to support a fence wire 2 above a ground surface 3 such that the standard is rotatable about the wire. The standard can comprise an insulated hub generally indicated by arrow 15 through which the wire 2 passes, a plurality of electrically conductive legs 5 extending radially outwardly from the hub, and a contactor generally indicated by arrow 6 which is adapted to make contact with all legs of the fence standard except those in contact with the ground surface 3, at a given time.

Thus the invention automatically electrically connects and disconnects successively the various legs 5 from the fence wire 2 as the standard is rotated to prevent the legs in ground contact from short-circuiting the fence.

Figure 2:
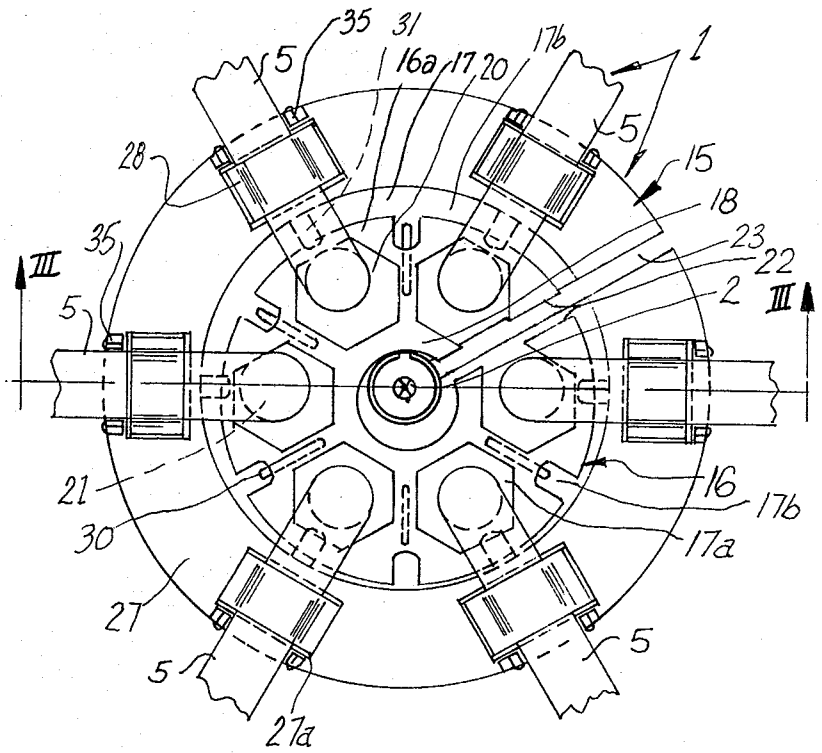
FIG. 2 is a side view of a hub and portion of the legs for an electric fence standard in accordance an embodiment of the present invention.
Figure 3:
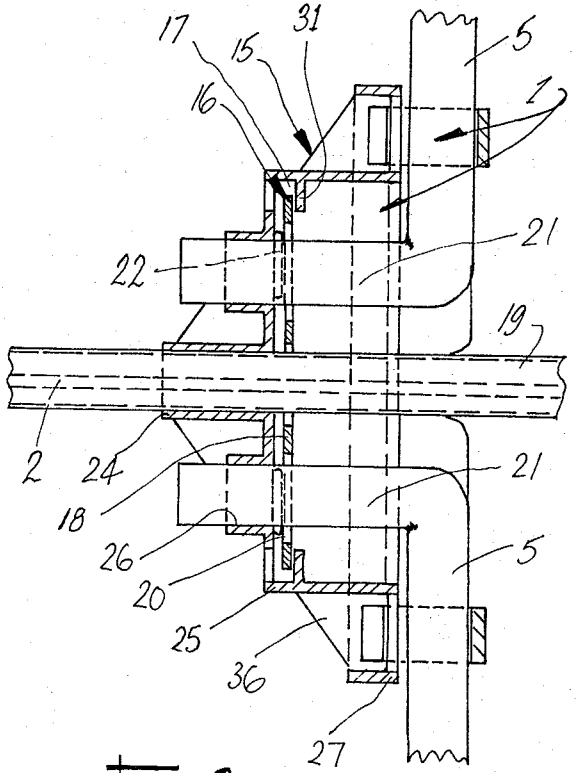
FIG. 3 is a diagrammatic cross-sectional view of the hub and legs for the fence standard of figure taken at III:III.

With reference to FIGS. 2 and 3, a fence standard 1 in accordance with a further embodiment of the present invention for supporting the electric fence wire 2, may comprise a hub generally indicated by arrow 15, arranged to receive and support the electric fence wire 2, said hub 15 mounting a plurality of radially spaced and extending legs 5, which in use support the standard 1 from a ground surface 3. The hub 15 is arranged to accommodate a contactor generally indicated by arrow 16, said contactor being arranged to ensure that an electric current is distributed to the legs 5 of the standard not in contact with the ground surface whilst no electric current reaches those legs 5 of the standard which are in contact with the ground surface.

The contactor is an apertured disc accommodated within a chamber 17 of the hub 15 such that an inner portion 18 thereof makes contact with an electrified wire supporting member 19 passing through the hub 15 whilst radially spaced apertures 20 of the disc are arranged to surround inner inturned ends 21 of the legs 5 mounted by the hub 15.

The hub 15 and the contactor 16 are each provided with radially extending slots 22 and 23 respectively, such that a fence wire 2 can be conveniently introduced into the hub 15.

The hub of the standard can comprise an axial sleeve 24 and intermediate mounting portion 25 defining the chamber 17 for accommodating the contactor 16, and a plurality of radially spaced apertures 26 for receiving the ends 21 of the legs 5. An outer flange 27 fixed to or intergrally formed with the intermediate portion is provided, said outer flange including a plurality of support means 28 such as U-shaped resilient clips, whose ends engage with rectangular apertures 27*a*, for supporting inner ends 21 of said legs 5.

Whilst the legs 5 have their inner ends 21 engaging in the aperture 26 in the intermediate portion 25 of the hub, the outer ends 29 (see FIG. 1) which may also be inturned are arranged to ensure that the weight of the standard is more evenly spread on the ground surface then would be the case if the ends 29 of the legs 5 were plain.

In the embodiment illustrated and by way of example, six legs are provided and correspondingly the hub provides six apertures 26, six sets of mounting means 28 in which the inner ends of legs 5 may be a snap fit, and six apertures 20 for surrounding the ends 21 of the legs 5 are provided in the contactor 16, the arrangement being such that on assembly of the legs 5 to the hub 15, the ends 21 of the legs project through the apertures 20 in the contactor 16.

Preferably, the apertures 20 in the contactor 16 are provided with a number of straight edges, that is, the apertures may be hexagonal as shown such that when the standard is rotated to a new position, there is a reduced likelihood of the contactor sticking. Further, the contactor is free to float in its chamber 17 such that in the position illustrated by FIG. 1, where two of the legs 5 are in contact with the ground below, there is a clear and regular air space 17*a* between the ends 21 of the legs in contact with the ground, and the inner edges of the apertures 20 in the contactor. Thus there is no electrical contact between the contactor 16 and the legs 5 in contact with the ground.

After an electric fence wire 2 has been introduced to the hub and contact plate 10, via slits 22 and 23 respectively, ringlet clamps (not shown) may be mounted on the wire support member to prevent dislocation of the wire from the standard.

Preferably the hub 15 for a support means in accordance with the present invention is moulded in a plastics material whilst the contact plate may be fabricated in an aluminium alloy, and similarly the legs 5 may be fabricated from an electrically conductive material, such as aluminium.

So that the contactor 16 has minimal frictional contact surface 17*b* of the chamber 17 the surfaces may be provided with a plurality of equally radially spaced ribs 30, and to prevent lateral movement of the contactor 17 a series of tabs 31 can be provided which overlie and locate the outer edges 16*a* of the contactor 16.

In alignment with the apertures 27*a* and the support means 28 supporting the ends 21 of the legs 5, the flange 27 may be provided with a series of outwardly extending U-shaped supports or guides 35 intergrally formed with the flange 27; and to strengthen the hub 15 a plurality of radially extending support braces 36 (see FIG. 3) can be provided.

I claim:

1. An electric fence standard for supporting a fence wire above a ground surface such that the standard is rotatable about the wire to permit translation of the wire, the electric fence standard comprising, an insulated hub through which the wire passes, a plurality of electrically conductive legs extending radially outwardly from the hub, and a contactor mounted in the hub which make contact with all legs of the fence standard except those in contact with the ground surface at a given time.

2. An electric fence standard as claimed in claim 1 wherein the contactor is an electrically conductive disc.

3. An electric fence standard as claimed in claim 2 wherein the hub mounts and supports the legs and an elongate wire supporting tube.

4. An electric fence standard as claimed in claim 3 wherein the contactor is an apertured disc accommodated within the chamber of the hub such that an inner portion thereof will be in contact with the elongate wire supporting tube whilst other radially spaced apertures of the disc surround the ends of the legs mounted in the hub.

5. An electric fence standard as claimed in claim 4 wherein the legs are metal tubes having at their outer ends a foot formed by a bend in the tubes.

6. An electric fence standard as claimed in claim 5 wherein the hub, the contactor and the wire supporting tube are provided with radially positioned and alignable slots such that an electric fence wire can be secured to the standard without the need to dismantle it.

7. An electric fence standard as claimed in claim 6 wherein the wire supporting tube is provided with at least two ringlets arranged to prevent dislocation of the wire.

* * * * *